US010225673B2

(12) United States Patent
DeChellis

(10) Patent No.: US 10,225,673 B2
(45) **Date of Patent: *Mar. 5, 2019**

(54) SYSTEM FOR IDENTIFYING A SOURCE OF AN AUDIBLE NUISANCE IN A VEHICLE

(71) Applicant: Gulfstream Aerospace Corporation, Savannah, GA (US)

(72) Inventor: Vincent DeChellis, Savannah, GA (US)

(73) Assignee: Gulfstream Aerospace Corporation, Savannah, GA (US)

( * ) Notice: Subject to any disclaimer, the term of this patent is extended or adjusted under 35 U.S.C. 154(b) by 18 days.

This patent is subject to a terminal disclaimer.

(21) Appl. No.: 15/847,270

(22) Filed: Dec. 19, 2017

(65) Prior Publication Data

US 2019/0028823 A1 Jan. 24, 2019

Related U.S. Application Data

(63) Continuation of application No. 15/281,560, filed on Sep. 30, 2016, now Pat. No. 9,883,302.

(51) Int. Cl.

| | |
|---|---|
| ***H04R 29/00*** | (2006.01) |
| ***H04R 3/00*** | (2006.01) |
| ***H04R 1/40*** | (2006.01) |

(52) U.S. Cl.

CPC ..... *H04R 29/00* (2013.01); *H04R 1/406* (2013.01); *H04R 3/005* (2013.01); *H04R 2499/11* (2013.01)

(58) Field of Classification Search

CPC ..... H04R 29/00; H04R 1/406; H04R 3/005; H04R 29/008; H04R 1/326; H04R 2499/11; H04N 7/183

See application file for complete search history.

(56) References Cited

U.S. PATENT DOCUMENTS

2009/0028347 A1* 1/2009 Duraiswami ..... H04R 1/406 381/26
2014/0294183 A1* 10/2014 Lee ..... H04R 3/005 381/56

(Continued)

FOREIGN PATENT DOCUMENTS

JP 2014222189 A 11/2014

OTHER PUBLICATIONS

A document entitled "Web Page for the Bionic XS-56 Microphone Array" including a web page screenshot from www.cae-systems.de/en/products/acoustic-camera-sound-source-localization/bionic-xs-56.html and having a retrieval date of Aug. 11, 2017.

(Continued)

*Primary Examiner* — Brenda C Bernardi
(74) *Attorney, Agent, or Firm* — LKGlobal | Lorenz & Kopf, LLP

(57) ABSTRACT

A system is provided for identifying a source of an audible nuisance in a vehicle. The system includes a device configured to receive a visual dataset, and to generate a camera signal in response thereto. The system includes a dock configured to removably couple to the device. The dock includes a microphone array configured to receive the audible nuisance, and to generate a microphone signal in response thereto. The system includes a processor module configured to be communicatively coupled with the device and the dock. The processor module is configured to generate a raw soundmap signal in response to the microphone signal. The processor module is configured to combine the camera signal and the raw soundmap signal, and to generate a camera/soundmap overlay signal in response to combining the camera signal and the raw soundmap signal.

26 Claims, 8 Drawing Sheets

(56) References Cited

U.S. PATENT DOCUMENTS

| | | | | |
|---|---|---|---|---|
| 2014/0314391 | A1* | 10/2014 | Kim | G11B 27/11 386/248 |
| 2015/0098577 | A1 | 4/2015 | Moore et al. | |
| 2015/0358752 | A1* | 12/2015 | Orman | G01S 3/8022 381/56 |
| 2016/0165341 | A1* | 6/2016 | Benattar | H04R 1/406 381/92 |
| 2016/0187454 | A1* | 6/2016 | Orman | G01S 3/8022 367/124 |
| 2016/0330545 | A1* | 11/2016 | McElveen | H04R 3/005 |
| 2017/0019744 | A1* | 1/2017 | Matsumoto | H04R 29/008 |

OTHER PUBLICATIONS

A document entitled "Technical Datasheet for the Bionic XS-56 Microphone Array" from www.cae-systems.de/fileadmin/CAEpage/Datenblaetter/datasheet-acoustic-camera-bionic-xs-56.pdf, having a creation date of Feb. 8, 2017 according to embedded meta data, and having a retrieval date of Aug. 11, 2017.

A document entitled "Web Page for the SeeSV-S205" including a web page screenshot from sine.ni.com/nips/cds/view/p/lang/en/nid/212553#productlisting and having a retrieval date of Aug. 14, 2017.

A document entitled "Product Overview for the SeeSV-S205" from http://www.smins.co.kr/_prog/_board/?mode=V&no=690&code=download&site_dvs_cd=en&menu_dvs_cd=0401&skey=&sval=&GotoPage, having a creation date of Apr. 27, 2015 according to embedded meta data, and having a retrieval date of Aug. 14, 2017.

* cited by examiner

SYSTEM FOR IDENTIFYING A SOURCE OF AN AUDIBLE NUISANCE IN A VEHICLE

CROSS-REFERENCE TO RELATED APPLICATION

This application is a continuation of U.S. patent application Ser. No. 15/281,560, filed Sep. 30, 2016, which is hereby incorporated in its entirety by reference.

TECHNICAL FIELD

The present invention generally relates to vehicles and more particularly relates to aircraft manufacturing, testing, and maintenance.

BACKGROUND

Vehicles, such as aircraft and motor vehicles, commonly include components that generate an audible nuisance (i.e., an undesirable noise). Not only is an audible nuisance distracting or annoying to occupants within the vehicle or people outside the vehicle, the audible nuisance may be an indication that the component is malfunctioning. The source of the audible nuisance is commonly due to noises, vibrations, squeaks, or rattling from moving or fixed components of the vehicle. Determining the source of the audible nuisance can be difficult. For example, other noises, such as engine or road noise, may partially mask the audible nuisance making determination of the source difficult. Further, the audible nuisance may only sporadically occur making reproducibility of the audible nuisance to determine the source difficult.

To address this issue, technicians and/or engineers trained to detect and locate audible nuisances commonly occupy the vehicle during a test run in an attempt to determine the source of the audible nuisance. These test runs can be expensive and time consuming. For example, determination of the source of a nuisance noise in an aircraft during a test run commonly requires the usage of additional personnel (e.g., technicians, engineers, and pilots), the usage of additional fuel, and taking the aircraft out of normal service. While this solution is adequate, there is room for improvement.

Accordingly, it is desirable to provide a system for identifying a source of an audible nuisance in a vehicle and a method for the same. Furthermore, other desirable features and characteristics will become apparent from the subsequent summary and detailed description and the appended claims, taken in conjunction with the accompanying drawings and the foregoing technical field and background.

BRIEF SUMMARY

Various non-limiting embodiments of a system for identifying a source of an audible nuisance in a vehicle, and various non-limiting embodiments of methods for the same, are disclosed herein.

In one non-limiting embodiment, the system includes, but is not limited to, a device configured to receive a visual dataset, and to generate a camera signal in response to the visual dataset. The system further includes a dock configured to removably couple to the device. The dock includes a microphone array configured to receive the audible nuisance, and to generate a microphone signal in response to the audible nuisance. The system also includes a processor module configured to be communicatively coupled with the device and the dock. The processor module is further configured to generate a raw soundmap signal in response to the microphone signal. The processor module is also configured to combine the camera signal and the raw soundmap signal, and to generate a camera/soundmap overlay signal in response to combining the camera signal and the raw soundmap signal.

In another non-limiting embodiment, the method includes, but is not limited to, utilizing a system including a device and a dock. The device includes a display, and the dock includes a microphone array. The method further includes, but is not limited to, receiving a visual dataset. The method also includes, but is not limited to, generating a camera signal in response to the visual dataset. The method further includes, but is not limited to, receiving the audible nuisance utilizing the microphone array. The method also includes, but is not limited to, generating a microphone signal in response to the audible nuisance. The method further includes, but is not limited to, generating a raw soundmap signal in response to the microphone signal. The method also includes, but is not limited to, combining the camera signal and the raw soundmap signal. The method further includes, but is not limited to, generating a camera/soundmap overlay signal in response to combining the camera signal and the raw soundmap signal. The method further includes, but is not limited to, displaying the camera/soundmap overlay signal on the display.

BRIEF DESCRIPTION OF THE DRAWINGS

The present invention will hereinafter be described in conjunction with the following drawing figures, wherein like numerals denote like elements.

DETAILED DESCRIPTION

Figure 1:
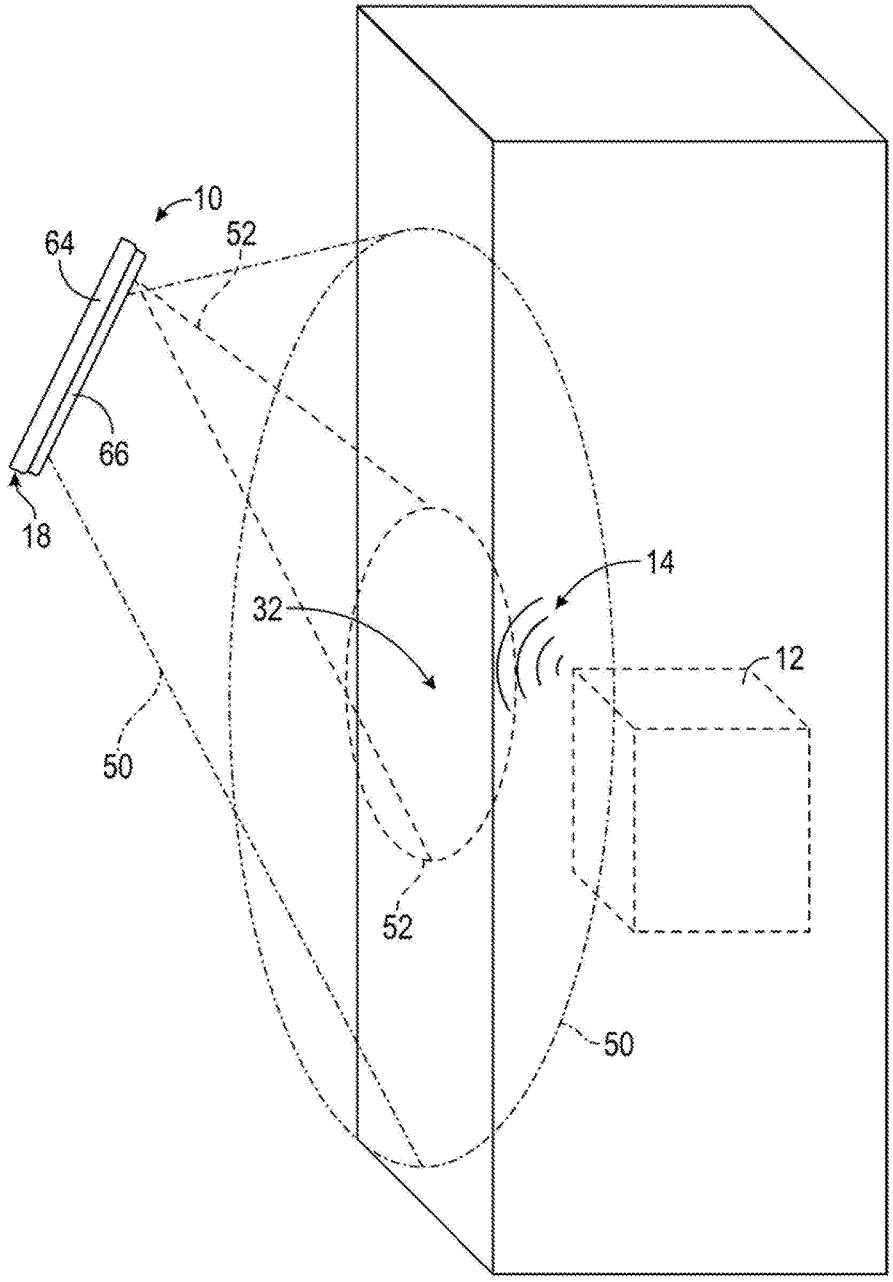
FIG. 1 is a perspective view illustrating a non-limiting embodiment of a system for identifying a source of an audible nuisance in a vehicle.

The following detailed description is merely exemplary in nature and is not intended to limit the invention or the application and uses of the invention. Furthermore, there is no intention to be bound by any theory presented in the preceding background or the following detailed description. It should be understood that throughout the drawings, corresponding reference numerals indicate like or corresponding parts and features. As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group)

and memory that executes one or more software or firmware programs, a combinational logic circuit, and/or other suitable components that provide the described functionality.

A system for identifying a source of an audible nuisance in a vehicle is taught herein. In an exemplary embodiment, the system is configured to include a device, such as a smartphone or a tablet, and a dock. The system can be stored onboard an aircraft and utilized by an aircrew member (or by any other person on board the aircraft during the flight) when an audible nuisance is present. In other words, the system can be utilized immediately upon detection of the presence of an audible nuisance by an aircrew member currently onboard the aircraft rather than waiting until a test flight can be performed with specialized crew members and equipment as conventionally performed. In embodiments, the device includes a camera having a camera field of view (FOV) and the dock includes a microphone array having an acoustic FOV with the camera FOV and the acoustic FOV in alignment.

When an audible nuisance is detected, the aircrew member can retrieve the system from storage in the aircraft. Next, the aircrew member can couple the dock to the device. However, it is to be appreciated that the dock may be already coupled to the device during storage. The aircrew member can then orient the microphone array and the camera toward a location proximate the source of the audible nuisance. The source may be located within a compartment that is hidden from view by a wall in an aircraft such that the camera will capture an image of the wall proximate the source and the microphone array will capture the audible nuisance from the source. In embodiments, a soundmap signal is generated from the audible nuisance with the soundmap signal overlaid over the image to generate a camera/soundmap overlay signal. In embodiments, an image of the camera/soundmap overlay signal includes a multicolored shading overlying the location with the presence of the shading corresponding to areas of the location propagating sound and the coloring of the shading corresponding to the amplitude of the sound from the soundmap signal. In embodiments, the device includes a display for displaying the camera/soundmap overlay signal which can be viewed by the aircrew member.

After generating the camera/soundmap overlay signal, the aircrew member can save the camera/soundmap overlay signal in a memory of the device or send the camera/soundmap overlay signal to ground personnel. The aircrew member may then remove the dock from the device and store the system in storage. However, it is to be appreciated that the dock can be coupled to the device during storage. During flight or once the aircraft lands, a technician on the ground can review the camera/soundmap overlay signal and identify the source of the audible nuisance without having to be onboard the aircraft during a test flight.

A greater understanding of the system described above and of the method for identifying a source of audible nuisance in a vehicle utilizing the may be obtained through a review of the illustrations accompanying this application together with a review of the detailed description that follows.

FIG. 1 is a perspective view illustrating a non-limiting embodiment of a system 10 for identifying a source 12 of an audible nuisance 14 in a vehicle. The audible nuisance 14 may be any sound. In some embodiments, audible nuisance 14 may have a frequency of from 20 to 20,000 Hz. It is to be appreciated that while the sound is referred to as an audible "nuisance," the sound does not necessary have to be undesirable. In other words, the audible nuisance 14 may be a desirable sound. The source 12 of the audible nuisance 14 may be due to noises, vibrations, squeaks, or rattling from moving or fixed components of the vehicle. The source 12 may be hidden from view by an obstruction, such as a wall, a compartment, a panel, a floor, a ceiling, etc.

Figure 2:
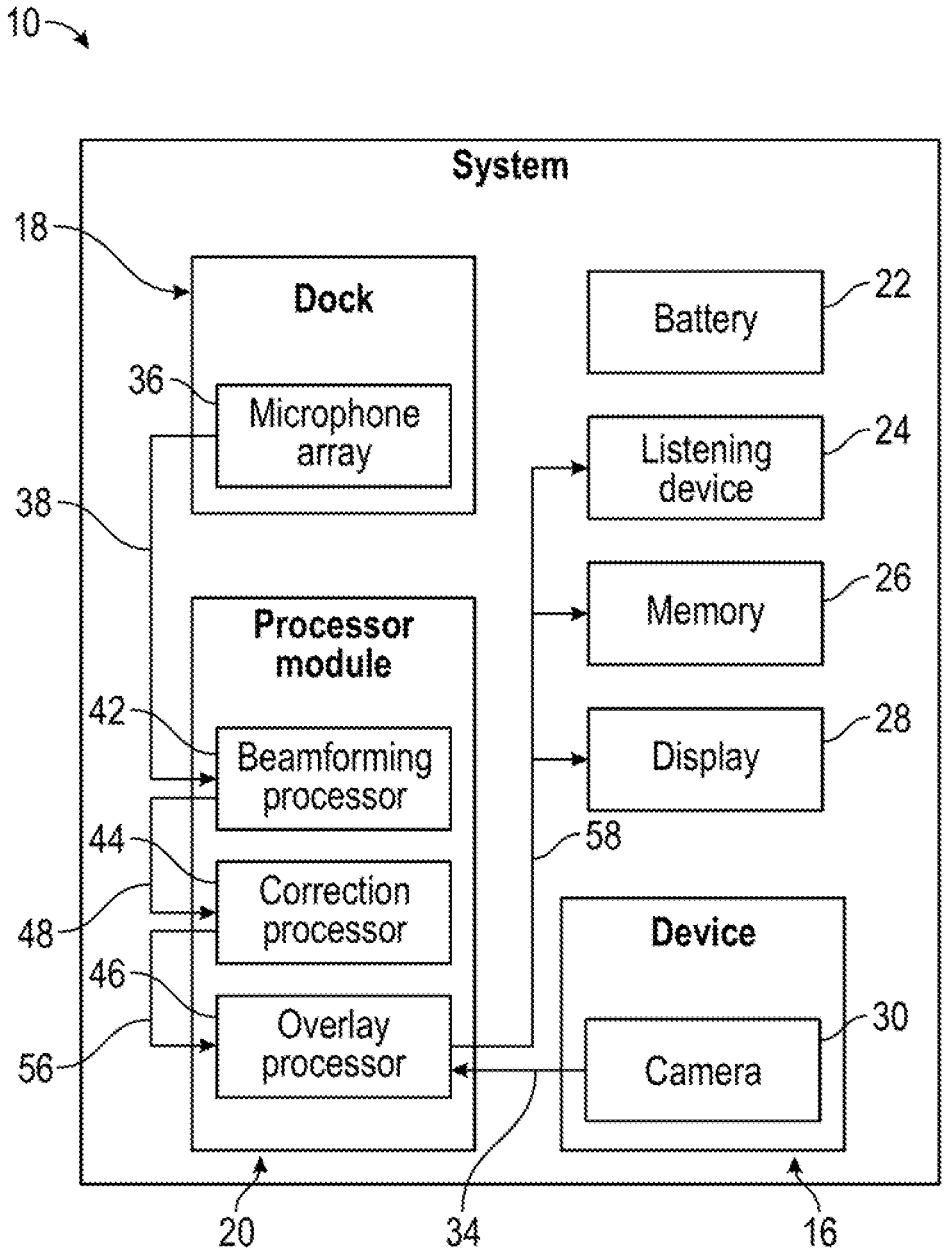
FIG. 2 is a block diagram illustrating a non-limiting embodiment of the system of FIG. 1.

FIG. 2 is a block diagram illustrating a non-limiting embodiment of the system 10. The system 10 includes a device 16, a dock 18, and a processor module 20. As will be described in greater detail below, the system 10 may further include a battery 22, a listening device 24, a memory 26, a display 28, or combinations thereof.

The device 16 includes a camera 30 configured to receive a visual dataset. The visual dataset may be an image, such as a still image or a video. With continuing reference to FIG. 1, when system 10 is employed to identify an audible nuisance, an operator may use device 16 to obtain a visual dataset from a location 32 proximate the source 12 of the audible nuisance 14. The location 32 proximate the source 12 may include an obstruction that hides the source 12 from view. As one non-limiting example, the source 12 may be located within a compartment that is hidden from view by a wall in an aircraft. In this example, the camera 30 will capture an image of the wall proximate the source 12. The camera 30 is further configured to generate a camera signal 34 in response to the visual dataset.

The dock 18 includes a microphone array 36 configured to receive the audible nuisance 14. In embodiments, the microphone array 36 has a frequency response of from 20 to 20,000 Hz. The microphone array 36 is further configured to generate a microphone signal 38 in response to the audible nuisance 14. In embodiments, the visual dataset received by camera 30 corresponds with the microphone signal 38 generated by the microphone array 36.

The microphone array 36 may include at least two microphones 40, such as a first microphone 40' and a second microphone 40". In embodiments, the first microphone 40' and the second microphone 40" are each configured to receive the audible nuisance 14. Further, in embodiments, the first microphone 40' is configured to generate a first microphone signal in response to the audible nuisance 14, and the second microphone 40" is configured to generate a second microphone signal in response to the audible nuisance 14. It is to be appreciated that each of the microphones 40 may be configured to each receive the audible nuisance, and to each generate a microphone signal 38 in response to receipt of the audible nuisance 14. In embodiments, the microphone array 36 includes microphones 40 in an amount of from 2 to 30, from 3 to 20, or from 5 to 15. In certain embodiments, the first microphone 40' and the second microphone 40" are spaced from each other in a distance of from 0.1 to 10, from 0.3 to 5, or from 0.5 to 3, inches. In other words, in an exemplary embodiment when the microphone array 36 includes fifteen microphones 40, at least two of the fifteen microphones 40, such as the first microphone 40' and the second microphone 40", are spaced from each other in a distance of from 0.1 to 10, from 0.3 to 5, or from 0.5 to 3, inches. Proper spacing of the microphones 40 results in increased resolution of the raw soundmap signal 48. In various embodiments, the microphones 40 are oriented in any suitable pattern, such as a spiral pattern or a pentagonal pattern.

The processor module 20 is configured to be communicatively coupled with the device 16 and the dock 18. In certain embodiments, the processor module 20 is further configured to be communicatively coupled with the camera 30 and the microphone array 36. In embodiments, the processor module 20 performs computing operations and accesses electronic data stored in the memory 26. The processor module 20 may be communicatively coupled through a communication channel. The communication channel may be wired, wireless or a combination thereof. Examples of wired communication channels include, but are not limited to, wires, fiber optics, and waveguides. Examples of wireless communication channels include, but are not limited to, Bluetooth, Wi-Fi, other radio frequency-based communication channels, and infrared. The processor module 20 may be further configured to be communicatively coupled with the vehicle or a receiver located distant from the vehicle, such as ground personnel. In embodiments, the processor module 20 includes a beamforming processor 42, a correction processor 44, an overlay processor 46, or combinations thereof. It is to be appreciated that the processor module 20 may include additional processors for performing computing operations and accessing electronic data stored in the memory 26.

The processor module 20 is further configured to generate a raw soundmap signal 48 in response to the microphone signal 38. More specifically, in certain embodiments, the beamforming processor 42 is configured to generate the raw soundmap signal 48 in response to the microphone signal 38. In embodiments, the raw soundmap signal 48 is a multi-dimensional dataset that at least describes the directional propagation of sound within an environment. The raw soundmap signal 48 may further describe one or more qualities of the microphone signal 38, such as, amplitude, frequency, or a combination thereof. In an exemplary embodiment, the raw soundmap signal 48 further describes amplitude of the microphone signal 38.

In embodiments, the microphone array 36 has an acoustic field of view (FOV) 50. In embodiments, the acoustic FOV 50 has a generally conical shape extending from the microphone array 36. In certain embodiments, the processor module 20 is further configured to receive the acoustic FOV 50. More specifically, in certain embodiments, the correction processor 44 is configured to receive the acoustic FOV 50. The acoustic FOV 50 may be predefined in the memory 26 or adaptable based on the condition of the environment (e.g., level and/or type of audible nuisance, level and/or type of background noise, distance of the microphone array 36 to the location 32 and/or the source 12, etc.). In certain embodiments, the processor module 20 is configured to remove any portion of the microphone signal 38 outside the acoustic FOV 50 from the raw soundmap signal 48 such that the raw soundmap signal 48 is free of any portion of the microphone signal 38 outside the acoustic FOV 50. The acoustic FOV 50 has an angular size extending from the microphone array 36 in an amount of from 1 to 180, 50 to 165, or 100 to 150, degrees.

In embodiments, the camera 30 has a camera FOV 52. In embodiments, the camera FOV 52 has a generally conical shape extending from the camera 30. In certain embodiments, the processor module 20 is further configured to receive the camera FOV 52. More specifically, in certain embodiments, the correction processor 44 is configured to receive the camera FOV 52. The camera FOV 52 has an angular size extending from the camera 30 in an amount of from 1 to 180, 50 to 150, or 100 to 130, degrees. In certain embodiments, the acoustic FOV 50 and the camera FOV 52 are at least partially overlapping. In various embodiments, the camera FOV 52 is disposed within the acoustic FOV 50. However, it is to be appreciated that the acoustic FOV 50 and the camera FOV 52 can have any spatial relationship so long as the acoustic FOV 50 and the camera FOV 52 are at least partially overlapping.

In embodiments, the processor module 20 is further configured to align the acoustic FOV 50 and the camera FOV 52, and generate a FOV correction signal in response to aligning the acoustic FOV 50 and the camera FOV 52. More specifically, in certain embodiments, the correction processor 44 is configured to align the acoustic FOV 50 and the camera FOV 52, and generate the FOV correction signal in response to aligning the acoustic FOV 50 and the camera FOV 52. In various embodiments, the angular size of the acoustic FOV 50 will be increased or decreased to render the acoustic FOV 50 and the camera FOV 52 aligned with each other. In one exemplary embodiment, when the camera FOV 52 is disposed within the acoustic FOV 50, the angular size of the acoustic FOV 50 is decreased to align with the camera FOV 52. In another exemplary embodiment, when the acoustic FOV 50 and the camera FOV 52 are partially overlapping, the angular size of the acoustic FOV 50 is decreased to align the acoustic FOV 50 with the camera FOV 52. It is to be appreciated that any properties and/or dimensions of the acoustic FOV 50 and the camera FOV 52 can be adjusted to align the acoustic FOV 50 and the camera FOV 52 with each other. Examples of properties and/or dimensions that can be adjusted includes, but are not limited to, resolutions, bit rates, lateral sizes of the FOVs, longitudinal sizes of the FOVs, circumferences of the FOVs, etc.

In embodiments, the processor module 20 is further configured to apply the FOV correction signal to the raw soundmap signal 48, and generate a corrected soundmap signal 56 in response to applying the FOV correction signal to the raw soundmap signal 48. More specifically, in certain embodiments, the correction processor 44 is configured to apply the FOV correction signal to the raw soundmap signal 48, and generate a corrected soundmap signal 56 in response to applying the FOV correction signal to the raw soundmap signal 48. In certain embodiments, the correction processor 44 is configured to remove any portion of the raw soundmap signal 48 outside the camera FOV 52 to generate the corrected soundmap signal 56.

The processor module 20 is also configured to combine the camera signal 34 and the raw soundmap signal 48, and generate a camera/soundmap overlay signal 58 in response to combining the camera signal 34 and the raw soundmap signal 48. More specifically, in certain embodiments, the overlay processor 46 is configured to combine the camera signal 34 and the raw soundmap signal 48, and generate the camera/soundmap overlay signal 58 in response to combining the camera signal 34 and the raw soundmap signal 48. In embodiments, the camera/soundmap overlay signal 58 is an image of the location 32 with the raw soundmap signal 48 overlying the location 32. Specifically, in embodiments, the image of the camera/soundmap overlay signal 58 includes a multicolored shading overlying the location 32 with the presence of the shading corresponding to areas of the location 32 propagating sound and the coloring of the shading corresponding to the amplitude of the sound from the raw soundmap signal 48.

In embodiments when the corrected soundmap signal is generated, the processor module 20 is also configured to combine the camera signal 34 and the corrected soundmap signal 56, and generate a camera/soundmap overlay signal 58 in response to combining the camera signal 34 and the corrected soundmap signal 56. More specifically, in certain embodiments, the overlay processor 46 is configured to combine the camera signal 34 and the corrected soundmap signal 56, and generate the camera/soundmap overlay signal 58 in response to combining the camera signal 34 and the corrected soundmap signal 56. In embodiments, the camera/ soundmap overlay signal 58 is an image of the location 32 with the corrected soundmap signal 56 overlying the location 32. Specifically, in embodiments, the image of the camera/soundmap overlay signal 58 includes a multicolored shading overlying the location 32 with the presence of the shading corresponding to areas of the location 32 propagating sound and the coloring of the shading corresponding to the amplitude of the sound from the corrected soundmap signal 56.

Figure 3:
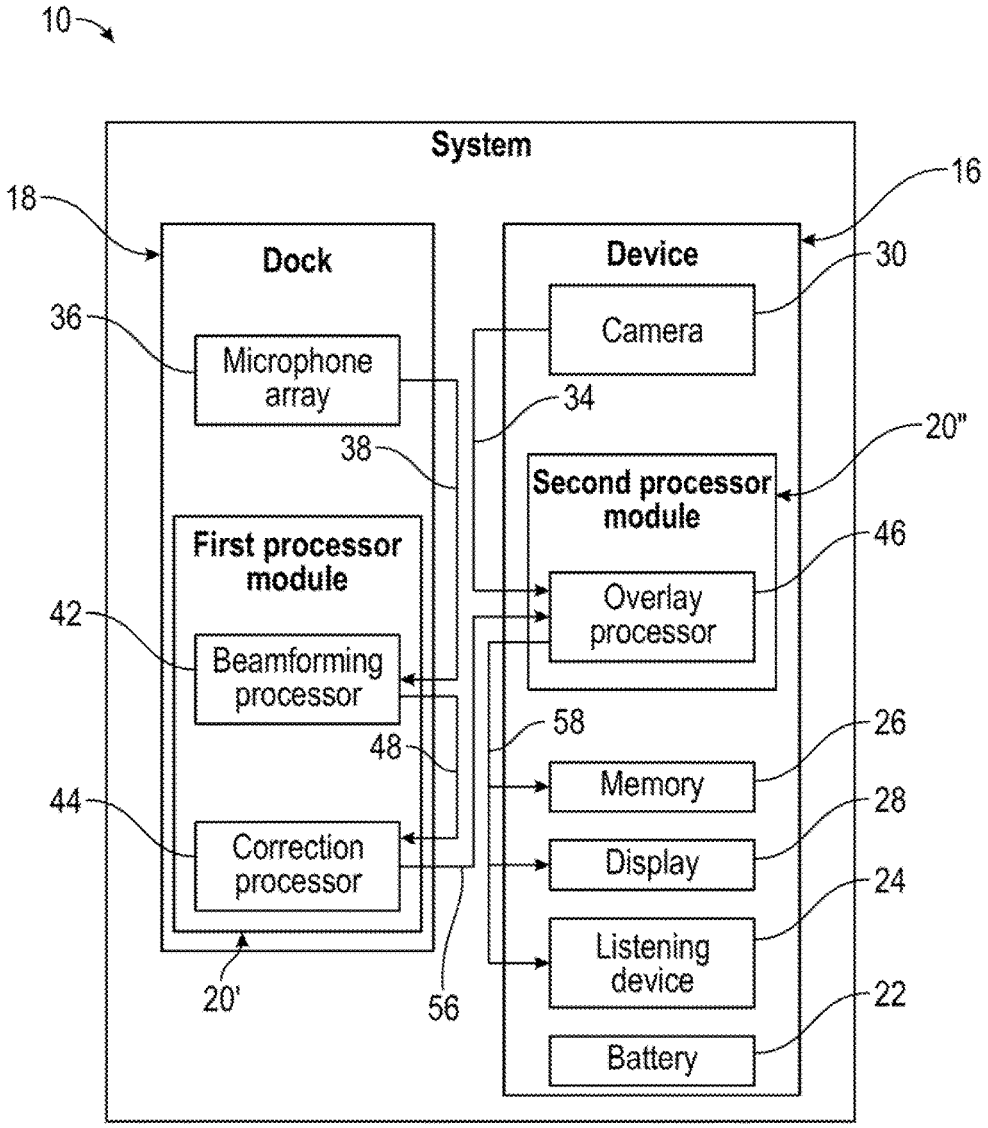
FIG. 3 is a block diagram illustrating another non-limiting embodiment of the system of FIG. 1.

FIG. 3 is a block diagram illustrating another non-limiting embodiment of the system 10 of FIG. 1. In embodiments, the processor module 20 is associated with the device 16, the dock 18, or both the device 16 and the dock 18. However, it is to be appreciated that the processor module 20 may be separate from both the device 16 and dock 18. In certain embodiments, the processor module 20 includes a first processor module 20' and a second processor module 20". The first processor module 20' may include the beamforming processor 42 and the correction processor 44. The second processor module 20" may include the overlay processor 46. In one exemplary embodiment, the first processor module 20' may be associated with the dock 18 such that the beamforming processor 42 and the correction processor 44 are associated with the dock 18, and the second processor module 20" may be associated with the device 16 such that the overlay processor 46 is associated with the device 16. The beamforming processor 42, the correction processor 44, and the overlay processor 46 are configured to be communicatively coupled with each other, the camera 30, and the microphone array 36.

Figure 4:
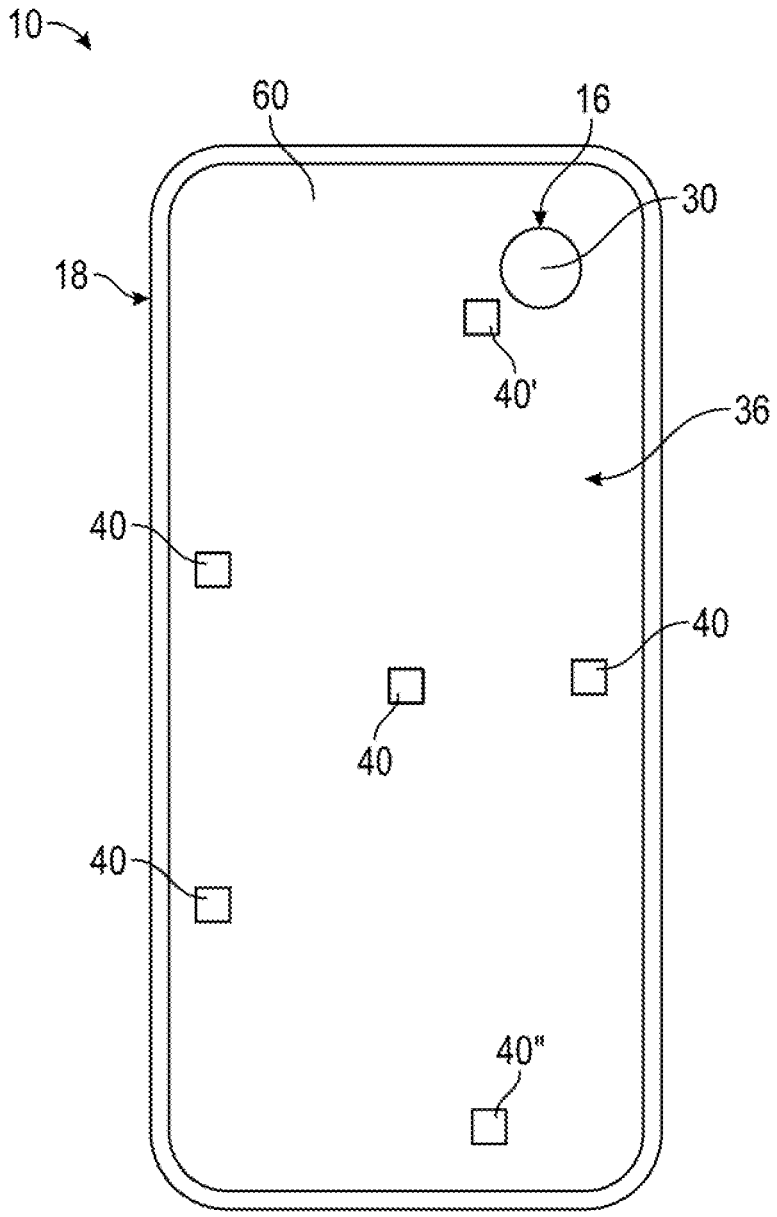
FIG. 4 is an elevational view illustrating a rear view of a non-limiting embodiment of the system of FIG. 1.
Figure 5:
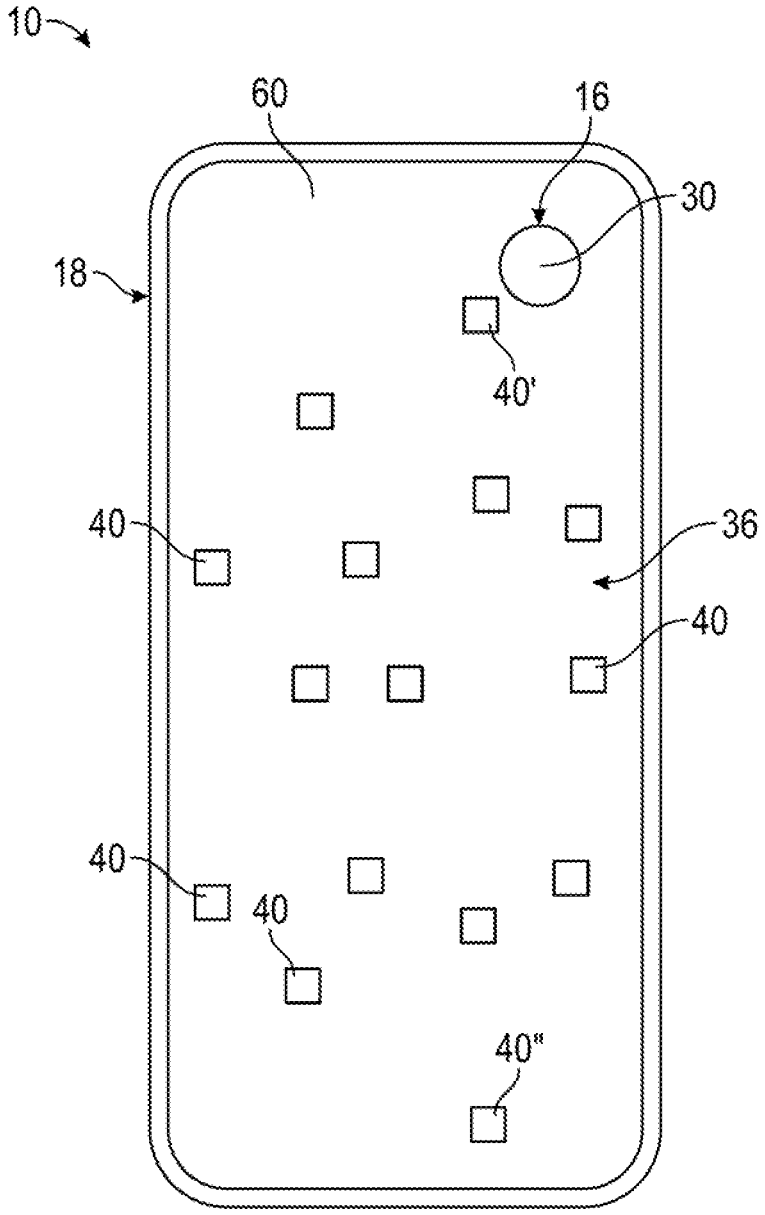
FIG. 5 is an elevational view illustrating a rear view of another non-limiting embodiment of the system of FIG. 1.

FIGS. 4 and 5 are elevational views illustrating rear views of non-limiting embodiments of the system 10 of FIG. 1. The dock 18 has a first face (not shown) configured to receive the device 16 and a second face 60 including the microphone array 36 with the microphone array 36 facing away from the dock 18. As shown in FIG. 4, in certain embodiments, the microphone array 36 includes six microphones. As shown in FIG. 5, in certain embodiments, the microphone array 36 includes fifteen microphones.

As also shown in FIGS. 4 and 5, the camera 30 of the device 16 is exposed through the dock 18. The dock 18 may define an orifice to expose the camera 30 though the dock 18. In embodiments, the camera 30 is offset from a center of the microphone array 36. Due to the offset placement of the camera 30 in relation to the microphone array 36, correction of the raw soundmap signal 48 may be necessary utilizing the correction processor 44. The camera 30 may be a video camera, a still camera, thermographic camera, or any other type of camera known in the art for receiving a visual dataset. In an exemplary embodiment, the camera 30 is a video camera.

Figure 6:
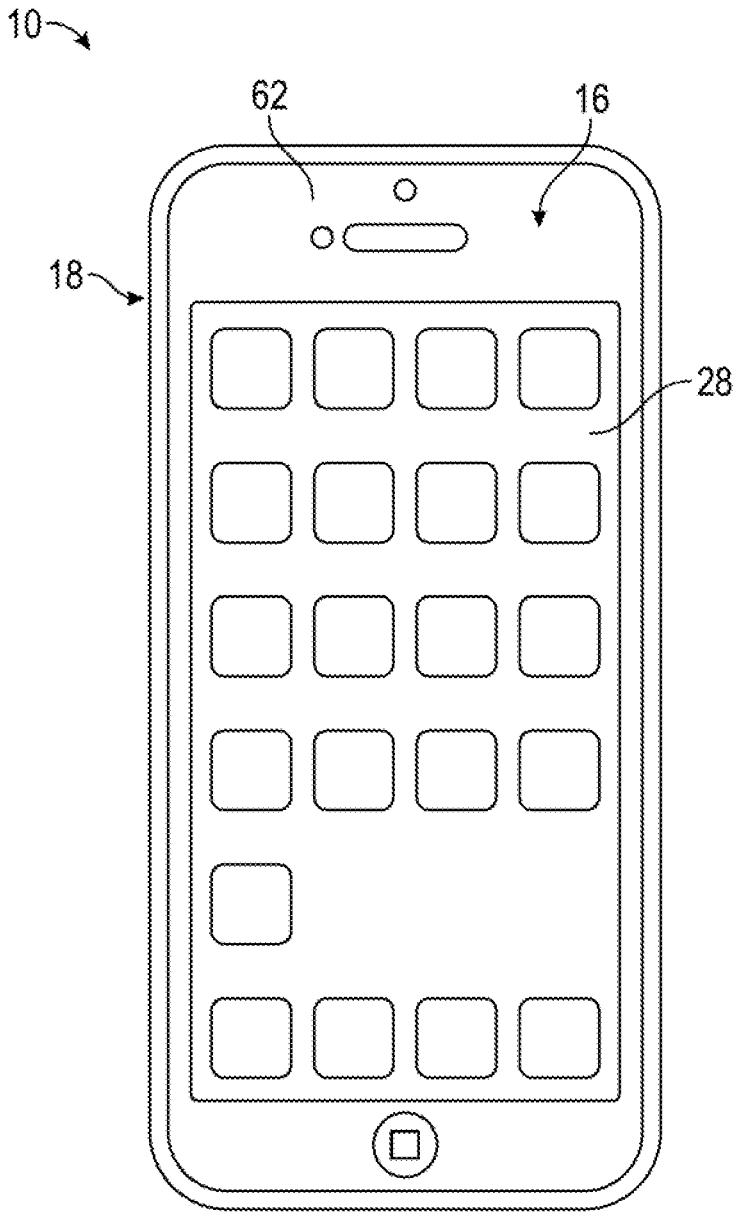
FIG. 6 is an elevational view illustrating a front view of a non-limiting embodiment of the system of FIG. 1.

FIG. 6 is an elevational view illustrating a front view of a non-limiting embodiment of the system 10 of FIG. 1. The dock 18 is configured to removably couple to the device 16. The device 16 has a first face 62 and a second face (not shown) opposite the first face 62. The first face 62 and the second face of the device 16 may extend to a device periphery (not shown). The dock 18 may be configured to receive the device 16 and extend about the device periphery, such as a case for a smartphone. However, it is to be appreciated that the dock 18 may only partially receive the device 16. In certain embodiments, the device 16 is further defined as a mobile device. Examples of a mobile device includes, but is not limited to, a mobile phone (e.g., a smartphone), a mobile computer (e.g., a tablet or a laptop), a wearable device (e.g., smart watch or headset), holographic projector, or any other type of device known in the art including a camera. In an exemplary embodiment, the mobile device is a smartphone or a tablet.

The device 16 may include its own processor that functions as the overlay processor 46 in addition to other computing functions related to the device 16 itself. In embodiments, the camera 30 (shown in FIGS. 4 and 5) is associated with the second face of the device 16 such that, during use of the system 10, the second face of the device 16 and the camera 30 face toward the location 32 proximate the source 12 of the audible nuisance 14. The first face 62 of the device 16 may further include the display 28 with the display 28 configured to display the camera/soundmap overlay signal 58. It is to be appreciated that the display 28 may be configured to display any signal generated by the system 10.

Figure 7:
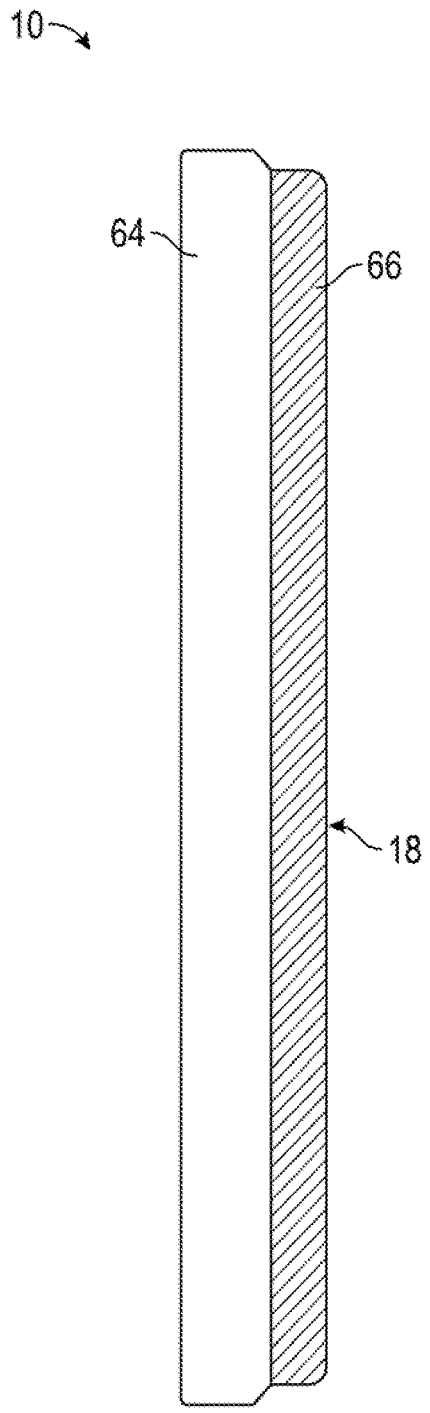
FIG. 7 is a perspective view illustrating a side view of a non-limiting embodiment of the system of FIG. 1.
Figure 8:
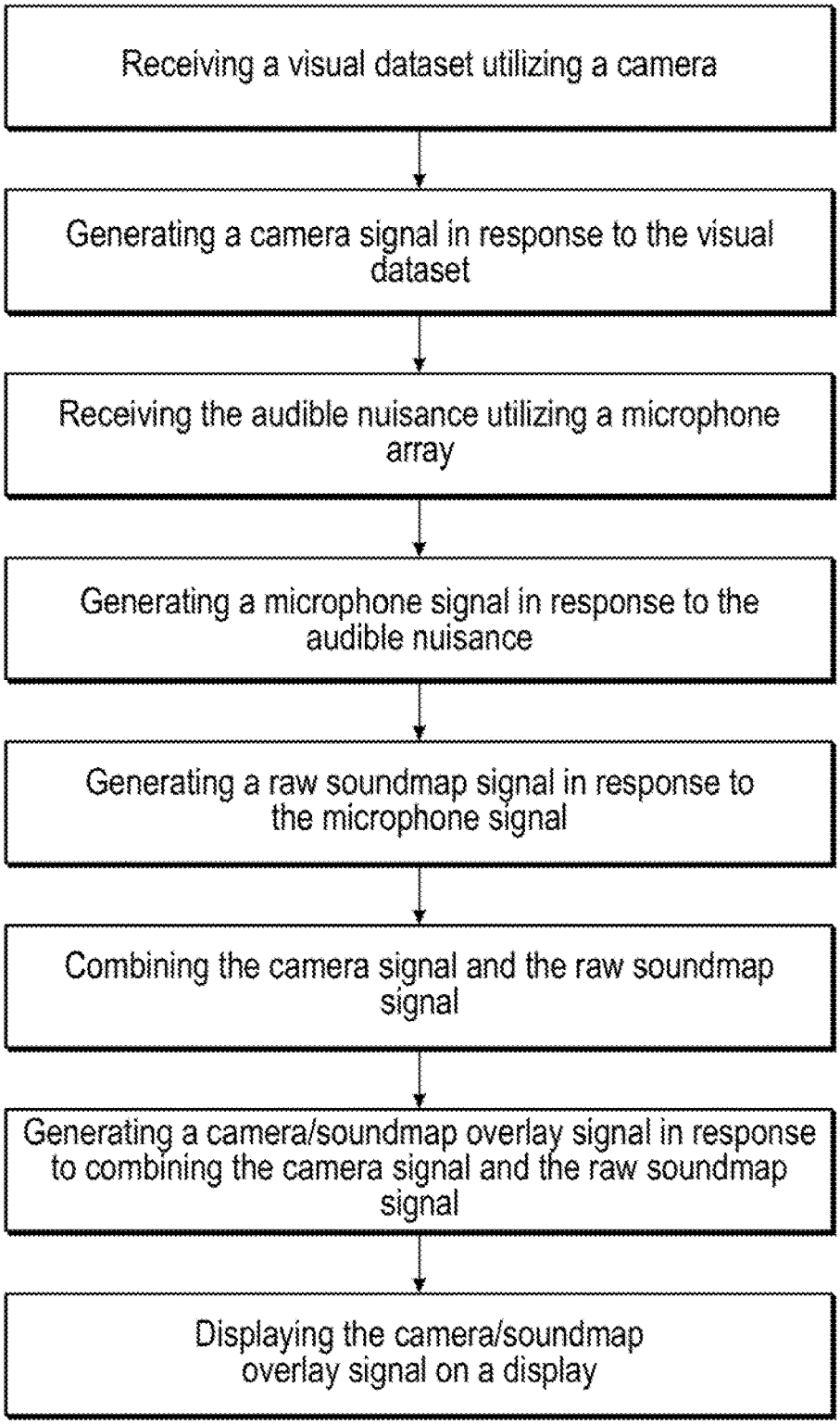
FIG. 8 is a flow chart illustrating a non-limiting embodiment of a method for identifying a source of an audible nuisance in a vehicle utilizing the system of FIG. 1.

FIG. 7 is a perspective view illustrating a side view of a non-limiting embodiment of the system of FIG. 1. In embodiments, the dock 18 includes a first portion 64 and a second portion 66 adjacent the first portion 64. The first portion 64 is configured to removably coupled to the device 16. The second portion 66 includes the microphone array 36, the beamforming processor 42, and the correction processor 44.

As introduced above and shown in FIG. 1, the system 10 may further include the memory 26 with the memory 26 configured to define the camera/soundmap overlay signal 58 in the memory 26. However, it is to be appreciated that the memory 26 may be configured to define any signal generated by the system 10. In certain embodiments, as shown in FIG. 2, the device 16 includes the memory 26. However, it is to be appreciated that the memory 26 may be associated with the dock 18 or separate from the device 16 and the dock 18.

As also introduced above and shown in FIG. 1, the system 10 may further include the listening device 24 with the listening device 24 configured to broadcast the camera/soundmap overlay signal 58. However, it is to be appreciated that the listening device 24 may be configured to broadcast any signal generated by the system 10. In certain embodiments, as shown in FIG. 2, the device 16 includes the listening device 24. However, it is to be appreciated that the listening device 24 may be associated with the dock 18 or separate from the device 16 and the dock 18.

As also introduced above and shown in FIG. 1, the system 10 may further include the battery 22 with the battery 22 configured to power at least one of the device 16 or the dock 18. However, it is to be appreciated that the battery 22 may be configured to power any component of the system 10. In certain embodiments, as shown in FIG. 2, the device 16 includes the battery 22. However, it is to be appreciated that the battery 22 may be associated with the dock 18 or separate from the device 16 and the dock 18.

The device 16 may further include a data port and the dock may further include a data connector. The data port may be configured to receive the data connector and electrically connect the data port to the data connector to form a data connection. The device 16 and the dock 18 may be configured to be communicatively coupled with each other over the data connection. Further, the data port and the data connector may be configured to transfer power from the battery 22 of the device 16 to the dock 18.

With continuing reference to FIGS. 1-7, FIG. 8 is a flow chart illustrating a non-limiting embodiment of a method for identifying the source 12 of the audible nuisance 14 in the vehicle utilizing the system 10 of FIG. 1. In embodiments, the method includes the step of coupling the dock 18 to the device 16. In embodiments, the method includes the step of orienting the dock 18 toward the source 12 such that the second face 60 of the dock 18 is facing the source 12. The method further includes the step of receiving a visual dataset utilizing the camera 30. The visual dataset may be received from the location 32 proximate the source 12 of the audible nuisance 14. The method further includes the step of generating the camera signal 34 in response to the visual dataset. The method further includes the step of receiving the audible nuisance 14 utilizing the microphone array 36. The method further includes the step of generating the microphone signal 38 in response to the audible nuisance 14. The method further includes the step of generating the raw soundmap signal 48 in response to the microphone signal 38. The method further includes the step of combining the camera signal 34 and the raw soundmap signal 48. The method further includes the step of generating the camera/soundmap overlay signal 58 in response to combining the camera signal 34 and the raw soundmap signal 48. The method further includes the step of displaying the camera/soundmap overlay signal 58 on the display 28.

In embodiments when the microphone array 36 has the acoustic FOV 50 and the camera 30 has the camera FOV 52, the method further includes the step of receiving the acoustic FOV 50 and the camera FOV 52. The method further includes the step of aligning the acoustic FOV 50 and the camera FOV 52. The method further includes the step of generating the FOV correction signal in response to aligning the acoustic FOV 50 and the camera FOV 52. The method further includes the step of applying the FOV correction signal to the raw soundmap signal 48. The method further includes the step of generating the corrected soundmap signal 56 in response to applying the FOV correction signal to the raw soundmap signal 48. The method further includes the step of combining the camera signal 34 and the corrected soundmap signal 56. The method further includes the step of generating the camera/soundmap overlay signal 58 in response to combing the camera signal 34 and the corrected soundmap signal 56.

In embodiments when the device 16 includes the listening device 24, the method further includes the step of broadcasting the camera/soundmap overlay signal 58 through the listening device 24. In embodiments when the device 16 includes the memory 26, the method further includes defining the camera/soundmap overlay signal 58 in the memory 26. In embodiments when the processor module 20 is communicatively coupled with the receiver located distant from the vehicle, such as ground personnel, the method includes the step of sending the camera/soundmap overlay signal 58 to the receiver.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the disclosure as set forth in the appended claims.

What is claimed is:

1. A system for identifying a source of an audible nuisance in a vehicle, the system comprising:

a device configured to receive a visual dataset, and to generate a camera signal in response to the visual dataset;

a dock configured to removably couple to the device, the dock comprising a microphone array configured to receive the audible nuisance, and to generate a microphone signal in response to the audible nuisance; and a processor module configured to be communicatively coupled with the device and the dock, to generate a raw soundmap signal in response to the microphone signal, to combine the camera signal and the raw soundmap signal, and to generate a camera/soundmap overlay signal in response to combining the camera signal and the raw soundmap signal.

2. The system of claim 1, wherein the device comprises a camera.

3. The system of claim 2, wherein the camera is configured to receive the visual dataset.

4. The system of claim 1, wherein the dock has a first face configured to receive the device and a second face comprising the microphone array with the microphone array facing away from the dock.

5. The system of claim 2, wherein the microphone array has an acoustic field of view (FOV), the camera has a camera FOV, and the acoustic FOV and the camera FOV are at least partially overlapping.

6. The system of claim 5, wherein the processor module is configured to remove any portion of the microphone signal outside the acoustic FOV from the raw soundmap signal.

7. The system of claim 5, wherein the processor module further comprises a correction processor configured to receive the acoustic FOV and the camera FOV, to align the acoustic FOV and the camera FOV, to generate a FOV correction signal in response to aligning the acoustic FOV and the camera FOV, to apply the FOV correction signal to the raw soundmap signal, and to generate a corrected soundmap signal in response to applying the FOV correction signal to the raw soundmap signal.

8. The system of claim 7, wherein the correction processor is associated with the dock.

9. The system of claim 7, wherein the processor module comprises an overlay processor configured to combine the camera signal and the corrected soundmap signal, and to generate the camera/soundmap overlay signal in response to combining the camera signal and the corrected soundmap signal.

10. The system of claim 9, wherein the overlay processor is associated with the device.

11. The system of claim 1, wherein the processor module comprises a beamforming processor configured to generate the raw soundmap signal in response to the microphone signal.

12. The system of claim 11, wherein the beamforming processor is associated with the dock.

13. The system of claim 1, wherein the microphone array comprises a first microphone and a second microphone, the first microphone and the second microphone are each configured to receive the audible nuisance, the first microphone is configured to generate a first microphone signal in response to receiving the audible nuisance, and the second microphone is configured to generate a second microphone signal in response to receiving the audible nuisance.

14. The system of claim 1, wherein the device comprises a data port and the dock comprises a data connector, the data port configured to receive the data connector and electrically connect the data port to the data connector to form a data connection, and the device and the dock are configured to be communicatively coupled with each other over the data connection.

15. The system of claim 1, wherein the device further comprises a memory configured to define the camera/soundmap overlay signal in the memory.

16. The system of claim 1, wherein the device further comprises a display configured to display the camera/soundmap overlay signal.

17. The system of claim 1, wherein the device is further defined as a mobile device.

18. A method for identifying a source of an audible nuisance in a vehicle utilizing a system comprising a device and a dock, the device comprising a display, and the dock comprising a microphone array, the method comprising:

receiving a visual dataset;

generating a camera signal in response to the visual dataset;

receiving the audible nuisance utilizing the microphone array;

generating a microphone signal in response to the audible nuisance;

generating a raw soundmap signal in response to the microphone signal;

combining the camera signal and the raw soundmap signal;

generating a camera/soundmap overlay signal in response to combining the camera signal and the raw soundmap signal; and displaying the camera/soundmap overlay signal on the display.

19. The method of claim 18, wherein the device further comprises a camera.

20. The method of claim 19, wherein the visual dataset is received utilizing the camera.

21. The method of claim 19, wherein the microphone array has an acoustic field of view (FOV) and the camera has a camera FOV with the acoustic FOV and the camera FOV at least partially overlapping, and wherein the method further comprises:

receiving the acoustic FOV and the camera FOV;

aligning the acoustic FOV and the camera FOV;

generating a FOV correction signal in response to aligning the acoustic FOV and the camera FOV;

applying the FOV correction signal to the raw soundmap signal; and generating a corrected soundmap signal in response to applying the FOV correction signal to the raw soundmap signal.

22. The method of claim 21, wherein the method further comprises:

combining the camera signal and the corrected soundmap signal, and generating the camera/soundmap overlay signal in response to combining the camera signal and the corrected soundmap signal.

23. The method of claim 18, wherein the device further comprises a memory, and wherein the method further comprises defining the camera/soundmap overlay signal in the memory.

24. The method of claim 18, further comprising coupling the dock to the device.

25. A system for identifying a source of an audible nuisance in a vehicle, the system comprising:

a mobile device proximate the source of the audible nuisance and configured to generate a camera signal in response to a visual dataset;

a dock configured to removably couple to the mobile device, the dock comprising a microphone array configured to receive the audible nuisance, and to generate a microphone signal in response to the audible nuisance; and a processor module configured to be communicatively coupled with the mobile device and the dock, to generate a raw soundmap signal in response to the microphone signal, to combine the camera signal and the raw soundmap signal, and to generate a camera/soundmap overlay signal in response to combining the camera signal and the raw soundmap signal.

26. A system for identifying a source of an audible nuisance in a vehicle, the system comprising:

a device and a dock, the device comprising a display, and the dock comprising a microphone array;

a memory for storing electronic data for executing one or more software programs for the identification of the source of the audible nuisance in the vehicle; and a processor module configured to execute the one or more software programs to:

receive a visual dataset;

generate a camera signal in response to the visual dataset;

receive the audible nuisance utilizing the microphone array;

generate a microphone signal in response to the audible nuisance;

generate a raw soundmap signal in response to the microphone signal;

combine the camera signal and the raw soundmap signal;

generate a camera/soundmap overlay signal in response to combining the camera signal and the raw soundmap signal; and display the camera/soundmap overlay signal on the display.

* * * * *